US006761000B1

(12) United States Patent
Heijting et al.

(10) Patent No.: US 6,761,000 B1
(45) Date of Patent: Jul. 13, 2004

(54) INFOBOARD AND ASSEMBLY OF SUCH INFOBOARD AND A PORTAL CRANE TRUCK

(75) Inventors: Eric Cornelis Johannes Hendrikus Heijting, Westervoort (NL); Jan Kemperman, Huissen (NL); Alexander Richardus Maria Hubers, Huissen (NL); Theodorus Hermanus Klaassen, Hussien (NL)

(73) Assignee: Bordbusters B.V. i.o., Huissen (NL)

( * ) Notice: Subject to any disclaimer, the term of this patent is extended or adjusted under 35 U.S.C. 154(b) by 0 days.

(21) Appl. No.: 09/518,039

(22) Filed: Mar. 3, 2000

(51) Int. Cl.[7] ..... E04B 1/346; E04B 7/16

(52) U.S. Cl. ..... 52/69; 52/71; 52/122.1; 40/588; 40/606.03; 40/610; 40/624; 160/135; 160/351; 404/6; 404/9; 404/10

(58) Field of Search ..... 40/624, 601, 606.03, 40/602, 610, 612, 607; 52/122.1, 125.4, 125.6, 126.3, 238.1, 116 B, 115, 71, 118, 119, 64, 69; 160/179, 135, 199, 206, 207, 351; 404/6, 9, 10

(56) References Cited

U.S. PATENT DOCUMENTS 648,402 A * 5/1900 Haarmann et al.
2,512,519 A * 6/1950 Covington et al.
2,693,655 A * 11/1954 Tschiedel
2,746,187 A * 5/1956 Ennever
3,616,557 A * 11/1971 Vira, Sr.
3,758,972 A * 9/1973 Egermayer ..... 40/125 K
3,768,186 A * 10/1973 Chase et al. ..... 40/125 K
4,005,537 A * 2/1977 vonCamber et al. ..... 40/125
4,071,970 A * 2/1978 Striski ..... 40/607
4,372,071 A * 2/1983 Vicino ..... 40/624
4,444,240 A * 4/1984 Bannister ..... 160/135
4,481,729 A * 11/1984 Weiller ..... 40/606
4,483,087 A * 11/1984 Stoyanov ..... 40/453
4,553,346 A * 11/1985 Glasener ..... 40/602
4,658,526 A * 4/1987 Glasener ..... 40/602
4,727,994 A * 3/1988 Beaulieu ..... 211/198
4,739,568 A * 4/1988 Gearhart ..... 40/603
4,829,688 A * 5/1989 Mouraret et al. ..... 40/622
4,879,965 A * 11/1989 Valley ..... 116/209
4,912,865 A * 4/1990 Ellsworth et al. ..... 40/602
5,251,570 A * 10/1993 Creech ..... 116/225
5,487,619 A * 1/1996 Winebrenner ..... 404/6
5,542,203 A * 8/1996 Luoma et al. ..... 40/610
5,737,862 A * 4/1998 Cooper et al. ..... 40/606
5,743,037 A * 4/1998 Martin ..... 40/610
5,974,712 A * 11/1999 Kallionpaa ..... 40/612
6,119,384 A * 9/2000 Fischer ..... 40/606

* cited by examiner

*Primary Examiner*—Brian E. Glessner
*Assistant Examiner*—Yvonne M. Horton
(74) *Attorney, Agent, or Firm*—Hoffmann & Baron, LLP

(57) ABSTRACT

An infoboard having at least one board part intended for an imprint, the infoboard comprising a frame carrying the at least one board part, the frame near an underside being firmly connected with the base, which base has such a weight that the infoboard is only movable by means of a lifting crane.

11 Claims, 1 Drawing Sheet

INFOBOARD AND ASSEMBLY OF SUCH INFOBOARD AND A PORTAL CRANE TRUCK

BACKGROUND OF THE INVENTION

1. Field of the Invention

The invention relates to an infoboard having at least one board part intended for an imprint, the infoboard comprising a frame carrying the at least one board part.

2. Description of the Prior Art

Such boards are, for instance, used at building projects to indicate who the principal, the contractor, the architect and/or the project developer of the building project is. Other data are often also mentioned on such boards, and sometimes an image of the project is shown. The known boards therefore have considerable dimensions, a board surface of 3×3 m constituting a standard.

It is a disadvantage of the known boards that they comprise a mostly wooden frame to be fixed in the ground. This often requires digging, which can be inconvenient, especially within the urban area. Thus, for instance, lines situated in the ground can be damaged. Moreover, often no free ground area can be found so that the pavement must be broken up, which is undesirable and, moreover, involves cost. After fixing the wooden frame parts in the ground the board parts have to be fastened to the frame parts. Since these board parts have considerable dimensions, they often have to be fastened by several persons at a time, which requires the use of ladders. It may be clear that during these activities accidents often occur because one of the persons holding the board during assembly falls off the ladder or cannot hold the board part any longer. Placing the known boards is therefore expensive because different persons are occupied therein for at least half a day. Moreover, the known boards cannot at all be placed everywhere.

OBJECT AND SUMMARY OF THE INVENTION

The object of the invention is to provide an infoboard without the above-mentioned disadvantages. The infoboard described in the opening paragraph is therefore characterized according to the invention in that near an underside the frame is firmly connected with a base, which base has such a weight that the infoboard is only movable by means of a lifting crane.

Through the presence of the base, the board can be directly placed on the ground area without digging being required. Moreover, the frame with the board parts fastened thereon is already assembled so that it is not necessary to still fasten the board parts on the frame. In an assembled condition, the infoboard can be placed at the destination by means of a lifting crane. Because the base has such a weight that the infoboard is only movable by means of a lifting crane, there is no risk that unauthorized persons will take away the board.

According to a further elaboration of the invention it is very favorable if the base and/or the frame are/is provided with fastening means for fastening lifting means of a lifting crane thereto.

It may be clear that the large dimensions of the infoboards can present problems during road transport owing to the height of the board. As is known, vehicles are not allowed to be higher than 4 m. The infrastructure, such as for instance flyovers, is designed for such a maximum height.

According to a further elaboration of the invention it is very favorable if the frame is provided with a hinge structure with a substantially horizontal swinging axis, the hinge connecting an upper part of the frame with a lower part. Through the presence of the hinge structure, an infoboard of considerable height can be designed. Nevertheless, road transport is possible because the height of the board can be reduced by folding the upper part.

The invention also relates to an assembly of an infoboard according to the invention and a portal crane truck, the dimensions of the infoboard and the portal crane truck being adjusted to each other such that in the folded condition of the infoboard the assembly has a height less than or equal to 4 m. With such an assembly, the infoboard can be readily transported over the road and placed by the portal crane at the desired destination.

Further elaborations of the invention are described in the subclaims and will hereinafter be explained in more detail, with reference to a practical example.

DETAILED DESCRIPTION OF THE PREFERRED EMBODIMENTS

Figure 1:
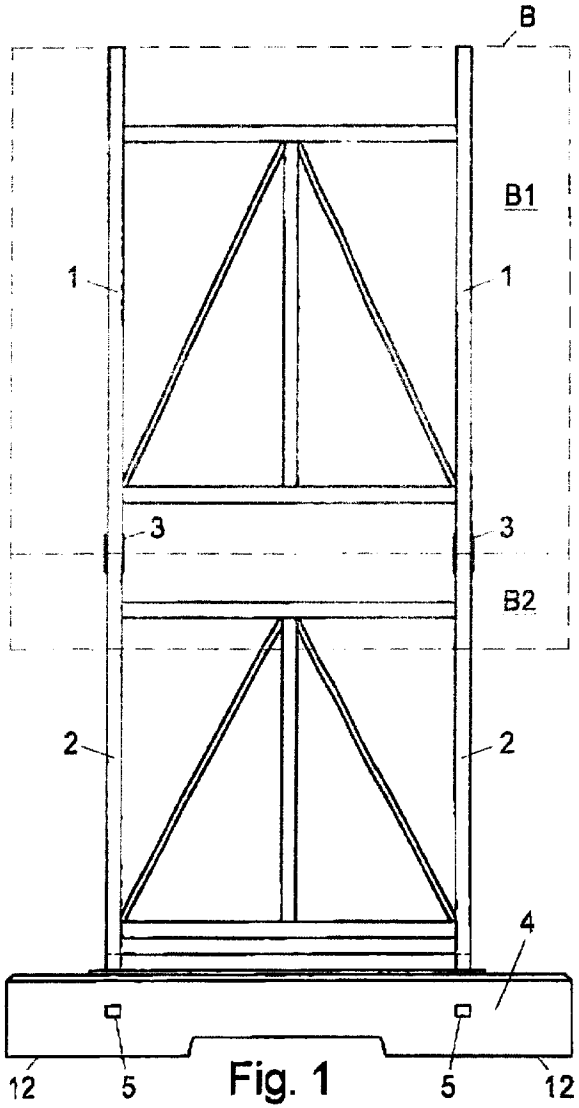
FIG. 1 is a front view of a practical example of the infoboard according to the invention.

The practical example shown has a board part B shown in FIG. 1 in dashed lines so that the frame structure is visible. The board part B is intended for an imprint. Furthermore, the infoboard comprises a frame 1, 2, which near an underside is firmly connected with a base 4. The base 4 has such a weight that the infoboard is only movable by means of a lifting crane. In the present practical example, the base 4 is therefore provided with fastening means 5 for fastening lifting means of a lifting crane thereto. The base is made of concrete and has a length of about 300 cm and a width of about 180 cm. Near the corners, the concrete base 4 is provided on the underside with a bearing surface 12 so that the base assumes a stable position on any ground. The fastening means 5 are designed as four pins 5 provided at the free end with a thickening. As a result of the presence of this thickening, the lifting means of the lifting crane are prevented from slipping off the pins. Each vertical longitudinal wall of the base 4 has such a pin 5 provided near each end of the longitudinal wall.

The upper surface of the concrete base 4 is provided with four fastening points 14 to which the frame 1, 2 is fastened.

Figure 2:
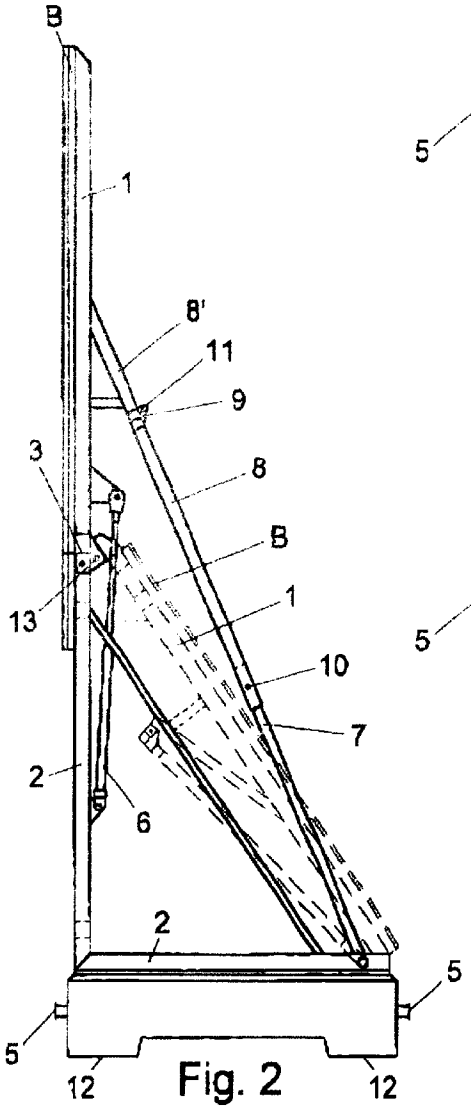
FIG. 2 is a side view of the practical example shown in FIG. 1.

As clearly visible in FIG. 2, the frame 1, 2 is provided with a hinge structure 3 with a substantially horizontal swinging axis. The hinge 3 connects an upper part 1 of the frame with a lower part 2. The board part B also comprises an upper part B1 and a lower part B2. The upper board part B1 is connected with the upper part 1 of the frame, while the lower board part B2 is connected with the lower part 2 of the frame. As a result of the presence of the hinge 3, the infoboard can assume a folded and an unfolded condition. In the folded condition transport of the board on, for instance, a portal crane truck is possible without any inconvenience.

Since the upper part 1 of the frame and the upper board part B1 fastened thereto have a considerable weight, the hinge structure is provided with an energized piston/cylinder assembly 6 and a shore 7, 8, 8'. The shore comprises two shore parts 7, 8 telescopically slidable with respect to each other. The shore part 8, 8' pointing towards the at least one board part B include a shore hinge 9 with a swinging axis extending substantially in the horizontal direction. The shore 8 is provided with a first and second locking means 10, 11, designed as locking pins, so that in the unfolded condition both the shore parts 7, 8 are telescopically movable with respect to each other and the shore hinge 9 can be locked. Preferably, the hinge 3 connecting the upper part 1 and the lower part 2 of the frame together further comprises a locking pin 13. In FIG. 2, the unfolded position of the board is shown in full lines, while the folded position is shown in dashed lines. Clearly visible is the manner in which the positions of the shore parts 7, 8, 8' and the frame parts 1, 2 have changed with respect to each other.

In order to prevent unauthorized persons from removing the locking pins and bringing the board from the unfolded position into the folded position, the energized piston/cylinder assembly 6 is of a removable design. After the infoboard has been brought into the unfolded condition and the locking pins 10, 11, 13 have been placed, the piston/cylinder assembly 6 is removed so that it can no longer be folded by unauthorized persons. The piston/cylinder assemblies 6 can be energized with, for instance, a separate hydraulic 24-volt unit, which is commercially available as a standard.

Figure 3:
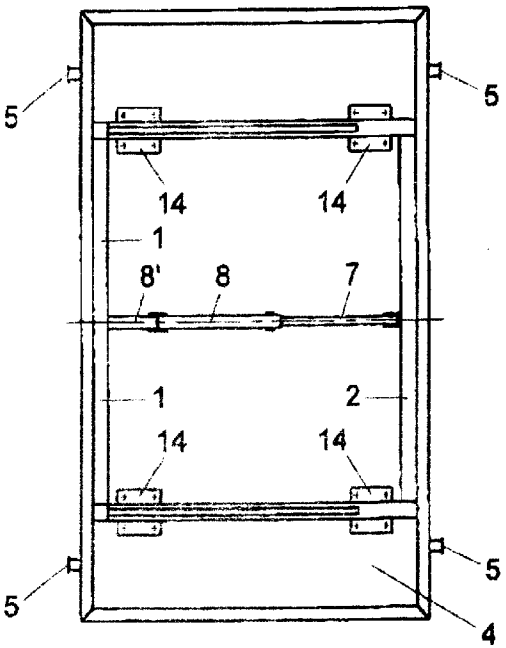
FIG. 3 is a top plan view of the practical example shown in FIG. 1.

From the top plan view shown in FIG. 3 it clearly follows that the concrete base 4 is provided on an upper surface with four fastening points 14 to which the frame 1 is fastened. The board parts B1, B2 can be very rapidly mounted by means of special U sections. In this way boards of different dimensions can be readily placed. It is preferred that on the transverse walls extending perpendicularly to the longitudinal walls the base is provided with coupling means so that a number of infoboards can be placed side by side to carry a larger board.

The infoboard shown herein can be transported on a standard portal crane truck. In the folded condition the height of the assembly of the portal crane truck and the infoboard will not exceed 4 m. The portal crane trucks are, for instance, known for the transport of open waste containers often used for building projects.

It is self-evident that the invention is not limited to the described practical example, but that diverse modifications are possible within the scope of the invention.

What is claimed is:

1. An infoboard having at least one board part intended for an imprint, the infoboard comprising a frame carrying the at least one board part, wherein, near an underside, the frame is firmly connected with a base, the base being made of concrete and having a weight that substantially prevents unauthorized persons from moving the infoboard without a lifting crane, the base being positioned entirely above the ground without requiring digging, wherein the frame is provided with a hinge structure with a substantially horizontal swinging axis, the hinge structure connecting an upper part of the frame with a lower part of the frame.

2. An infoboard according to claim 1, wherein at least one of the base and the frame is provided with a fastener for fastening a lifting structure of a lifting crane thereto.

3. An infoboard according to claim 1, wherein the hinge structure is provided with an energized piston/cylinder assembly and a shore, the shore comprising first, second and third shore ports, the first and second shore parts telescopically slidable with respect to each other, the second and third shore parts pointing towards the at least one board part including a shore hinge with a swinging axis extending substantially in the horizontal direction, at least a first and second locking structure being provided so that in the unfolded condition both the first and second short parts are telescopically movable with respect to each other and the short hinge is lockable.

4. An infoboard according to claim 3, wherein the energized piston/cylinder assembly is removable.

5. An infoboard according to claim 1, wherein a bearing surface is provided in the concrete base near each corner thereof.

6. An infoboard according to claim 2, wherein the fastener comprises four pins provided with a thickening that substantially prevents the lifting structure of the lifting crane from slipping off the pins, on each vertical longitudinal wall of the base at least one of the pins being provided near each end of the longitudinal wall.

7. An infoboard according to claim 1, wherein the concrete base is provided on an upper surface with four fastening points to which the frame is fastened.

8. An assembly of an infoboard according to any of the preceding claims and a portal crane truck, the dimensions of the infoboard and the portal crane truck being adjusted to each other such that in a folded condition of the infoboard the assembly has an overall height less than or equal to 4 m.

9. An infoboard having at least one board part intended for an imprint, the infoboard comprising a frame carrying the at least one board part, wherein, near an underside, the frame is firmly connected with a base, wherein the frame is provided with a hinge structure with a substantially horizontal swinging axis, the hinge structure connecting an upper part of the frame with a lower part of the frame, the base being made of concrete and having a weight that substantially prevents unauthorized persons from moving the infoboard without a lifting crane, the base being positioned entirely above the ground without requiring digging.

10. An infoboard according to claim 9, wherein the base has a length of about 300 cm and a width of about 180 cm.

11. An assembly of an infoboard according to any of the preceding claims and a portal crane truck, wherein the dimensions of the infoboard and the portal crane truck are adjusted to each other such that in a folded condition of the infoboard the assembly has an overall height less than or equal to 4 m, the infoboard having at least one board part intended for an imprint, the infoboard comprising a frame carrying the at least one board part, wherein, near an underside, the frame is firmly connected with a base, the base having a weight that substantially prevents unauthorized persons from moving the infoboard without a lifting crane, wherein the frame is provided with a hinge structure with a substantially horizontal swinging axis, the hinge structure connecting an upper part of the frame with a lower part of the frame.

* * * * *

UNITED STATES PATENT AND TRADEMARK OFFICE

CERTIFICATE OF CORRECTION

PATENT NO. : 6,761,000 B1
DATED : July 13, 2004
INVENTOR(S) : Heijting et al.

It is certified that error appears in the above-identified patent and that said Letters Patent is hereby corrected as shown below:

Column 4,
Line 10, now reads “short parts” should read -- shore parts --; and
Line 12, now reads “short hinge” should read -- shore hinge --.

Signed and Sealed this

Twenty-first Day of September, 2004

JON W. DUDAS
*Director of the United States Patent and Trademark Office*